US011121478B2

(12) United States Patent
Brandt et al.

(10) Patent No.: US 11,121,478 B2
(45) Date of Patent: Sep. 14, 2021

(54) CRIMP CONTACT WITH STRUCTURED REGION FOR PREVENTING CONDUCTOR SLIPPAGE DURING CRIMPING

(71) Applicant: TE Connectivity Germany GmbH, Bensheim (DE)

(72) Inventors: Jochen Brandt, Stoedtlen (DE); Uwe Bluemmel, Hemsbach (DE); Soenke Sachs, Frankfurt (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 16/844,372

(22) Filed: Apr. 9, 2020

(65) Prior Publication Data

US 2020/0328536 A1 Oct. 15, 2020

(30) Foreign Application Priority Data

Apr. 10, 2019 (DE) ..... 102019109460.7

(51) Int. Cl.
*H01R 4/18* (2006.01)

(52) U.S. Cl.
CPC ..... *H01R 4/185* (2013.01); *H01R 4/188* (2013.01)

(58) Field of Classification Search
CPC ..... H01R 4/185; H01R 4/188
USPC ..... 439/877
See application file for complete search history.

(56) References Cited

U.S. PATENT DOCUMENTS

| | | | | |
|---|---|---|---|---|
| 4,142,771 | A * | 3/1979 | Barnes | H01R 4/184 174/84 C |
| 7,121,903 | B2 * | 10/2006 | Sakaguchi | H01R 4/185 439/877 |
| 8,210,884 | B2 * | 7/2012 | Corman | H01R 4/185 439/877 |
| 8,221,171 | B2 * | 7/2012 | Ono | H01R 4/185 439/877 |
| 8,628,363 | B2 * | 1/2014 | Kobayashi | H01R 4/185 439/877 |
| 8,870,611 | B2 * | 10/2014 | Sato | H01R 4/188 439/877 |
| 9,039,467 | B2 * | 5/2015 | Seipel | H01R 4/20 439/877 |
| 9,099,794 | B2 * | 8/2015 | Ito | H01R 4/188 |
| 9,331,446 | B2 * | 5/2016 | Bluemmel | H01R 43/048 |
| 9,640,877 | B2 * | 5/2017 | Aoki | H01R 4/185 |
| 9,660,354 | B2 * | 5/2017 | Kamoshida | H01R 4/188 |
| 9,774,099 | B2 * | 9/2017 | Aoki | H01R 4/70 |
| 9,774,100 | B2 * | 9/2017 | Shinohara | H01R 43/055 |

(Continued)

FOREIGN PATENT DOCUMENTS

| | | |
|---|---|---|
| DE | 202013001074 U1 | 4/2013 |
| DE | 102015224219 A1 | 6/2017 |

(Continued)

*Primary Examiner* — Peter G Leigh
(74) *Attorney, Agent, or Firm* — Barley Snyder

(57) ABSTRACT

A crimp contact for crimping a conductor includes a crimp flank and a receptacle receiving the conductor and extending in a longitudinal direction of the crimp contact up to a receiving end. The crimp flank extends in the longitudinal direction over the receiving end up to a front end. The crimp flank encloses the conductor after crimping. The crimp contact has a structured region in a front region of the crimp contact arranged between the receiving end and the front end.

17 Claims, 5 Drawing Sheets

(56) References Cited

U.S. PATENT DOCUMENTS

| | | | | |
|---|---|---|---|---|
| 9,787,003 | B2 * | 10/2017 | Kamoshida | H01R 4/188 |
| 9,853,366 | B2 | 12/2017 | Nickel et al. | |
| 9,853,368 | B2 * | 12/2017 | Myer | H01R 4/188 |
| 9,972,932 | B2 * | 5/2018 | Copper | H01R 13/113 |
| 10,103,455 | B2 * | 10/2018 | Takahashi | H01R 43/048 |
| 10,128,581 | B2 * | 11/2018 | Seshimo | H01R 4/188 |
| 2010/0230160 | A1 * | 9/2010 | Ono | H01R 4/188 174/84 C |
| 2013/0115830 | A1 * | 5/2013 | Seifert | H01R 4/185 439/888 |
| 2014/0033520 | A1 * | 2/2014 | Nakagishi | H01R 43/048 29/753 |
| 2014/0378011 | A1 * | 12/2014 | Aizawa | H01R 4/18 439/877 |
| 2015/0147923 | A1 * | 5/2015 | Todo | H01R 4/62 439/882 |
| 2015/0244084 | A1 * | 8/2015 | Aizawa | H01R 4/18 439/878 |
| 2018/0358713 | A1 * | 12/2018 | Okuda | H01R 4/188 |
| 2018/0375225 | A1 * | 12/2018 | Ito | H01R 4/62 |
| 2019/0044253 | A1 * | 2/2019 | Ambo | H01R 4/185 |
| 2020/0067208 | A1 * | 2/2020 | Dix | H01R 43/0488 |

FOREIGN PATENT DOCUMENTS

| | | | |
|---|---|---|---|
| EP | 2214263 | A1 | 8/2010 |
| EP | 3179560 | A1 | 6/2017 |

* cited by examiner

CRIMP CONTACT WITH STRUCTURED REGION FOR PREVENTING CONDUCTOR SLIPPAGE DURING CRIMPING

CROSS-REFERENCE TO RELATED APPLICATION

This application claims the benefit of the filing date under 35 U.S.C. § 119(a)-(d) of German Patent Application No. 102019109460.7, filed on Apr. 10, 2019.

FIELD OF THE INVENTION

The present invention relates to a contact and, more particularly, to a crimp contact for crimping a conductor.

BACKGROUND

Crimp contacts commonly have two crimp flanks, which are arranged on either side of a crimp back. When the crimp contact is contacted by a conductor end, the conductor end is positioned between the crimp flanks and over the crimp back. The crimp flanks are then bent around the end of the conductor, for example using crimping pliers or a crimping tool. In this crimping procedure, the conductor is connected both mechanically and electrically to the crimp contact. Such a crimp contact is disclosed, for example, in German Patent Application No. 10 2015 224 219 A1.

During the crimping, an upper edge of the crimp flank can strike an inner side of the crimp flank. The crimp flank can then roll up and in this way adopt a spiral shape after the crimping. It can happen, however, that the upper edge slips on the inner side of the crimp flank, and as a result an unsatisfactory crimp connection arises.

SUMMARY

A crimp contact for crimping a conductor includes a crimp flank and a receptacle receiving the conductor and extending in a longitudinal direction of the crimp contact up to a receiving end. The crimp flank extends in the longitudinal direction over the receiving end up to a front end. The crimp flank encloses the conductor after crimping. The crimp contact has a structured region in a front region of the crimp contact arranged between the receiving end and the front end.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
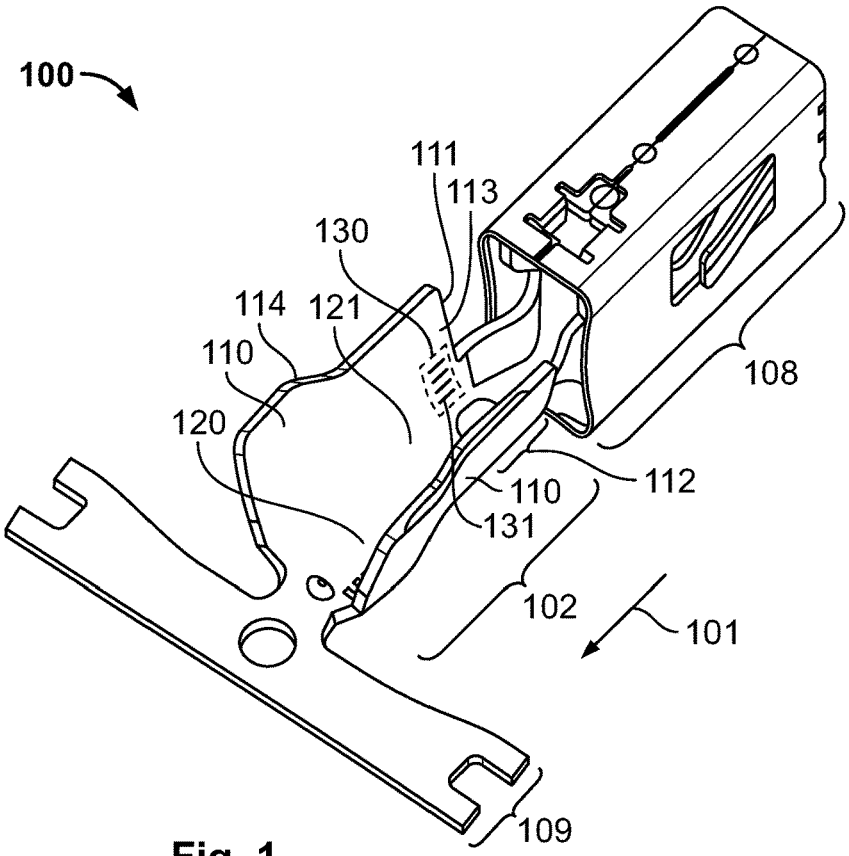
FIG. 1 is a perspective view of a crimp contact according to an embodiment.

Exemplary embodiments of the present invention will be described hereinafter in detail with reference to the attached drawings. For the sake of simplicity, the same reference numbers are used in the drawings for elements which correspond to one another in terms of function and/or design. The combination of features depicted and described using the exemplary embodiments serves solely as an example and can be changed within the scope of the invention. For example, it is possible to omit a feature whose technical effect is of no importance in a particular application. Conversely, it is possible to add a feature which is not present in the depicted combination of features of the exemplary embodiment if the technical effect linked to this feature is required for a particular application.

A crimp contact 100 according to an embodiment, which is suitable for crimping a conductor, is shown in FIG. 1. The crimp contact 100 has at least one crimpable crimp flank 110, with two such crimp flanks 110 being depicted in FIG. 1. The crimp flank 110 in this case serves to enclose the conductor after crimping. The crimp contact 100 has a receptacle 120 for the conductor, which receptacle 120 extends in a longitudinal direction 101 of the crimp contact 100 up to a receiving end 121. The crimp flank 110 is guided in the longitudinal direction 101 over the receiving end 121 up to a front end 111. A front region 112 of the crimp contact 100 is arranged between the receiving end 121 and the front end 111. The front region 112 of the crimp contact 100 has a structured region 130.

FIG. 1 shows that the two crimp flanks 110 form a crimp sleeve 102, into which a conductor can be inserted before the crimping. The crimp contact 100 also has a contact body 108 for forming a plug connection. The crimp contact 100 has a carrier strip 109, with which several crimp contacts 100 can be connected to each other during a manufacturing method and which can be removed before use, i.e. before the crimping of the crimp contact 100. It can be envisaged that the receiving end 121 is set up to be in alignment with one end of the conductor.

In an embodiment, the crimp contact 100 is formed from a metal sheet. A metal sheet in this case is a metallic material, which, in two directions of extension, has a significantly greater extent compared to a thickness of the material, therefore a sheet thickness. The sheet thickness, in this case, can be up to three millimeters. In an embodiment, the sheet thickness is between 150 micrometers and two millimeters. In an embodiment, the sheet thickness is between 200 and 400 micrometers. The crimp contact 100 depicted in FIG. 1 is formed from an appropriate metal sheet.

FIG. 1 shows that the structured region 130 is arranged on an inner side 113 of the crimp flank 110. On account of the perspective depiction in FIG. 1, the structured region 130 can be seen only on one of the two crimp flanks 110. A corresponding structured region 130 can, however, also be arranged on the opposite crimp flank 110, which structured region 130 is concealed by the perspective of the drawing in FIG. 1.

The structured region 130, as shown in FIG. 1, is formed from several structural elements 131 arranged parallel to the longitudinal direction 101. In this case, the structural elements 131 do not necessarily have to be arranged exactly parallel to the longitudinal direction 101. However, an arrangement of the structural elements 131 perpendicular to the longitudinal direction 101 is not possible. When the crimp contact 100 is crimped, an upper edge 114 of the crimp flank 110 can be guided by an appropriate crimping tool in such a way that the upper edge 114 on the inner side 113 of the crimp flank 110 strikes the structured region 130. By way of the structural elements 131, the upper edge 114 can be interlocked with the inner side 113 of the crimp flank 110 during the crimping procedure, and therefore a slippage of the upper edge 114 at the inside 113 of the crimp flank 110 can be avoided and/or the likelihood of slippage can be reduced. As a result, an improved crimp connection can be produced.

In the embodiment shown in FIG. 1, four structural elements 131 are arranged in the structured region 130. A different number of structural elements 131 can also be envisaged, in particular also only one structural element 131 per structured region 130 and thus in each case one structural element 131 on each crimp flank 110.

Figure 2:
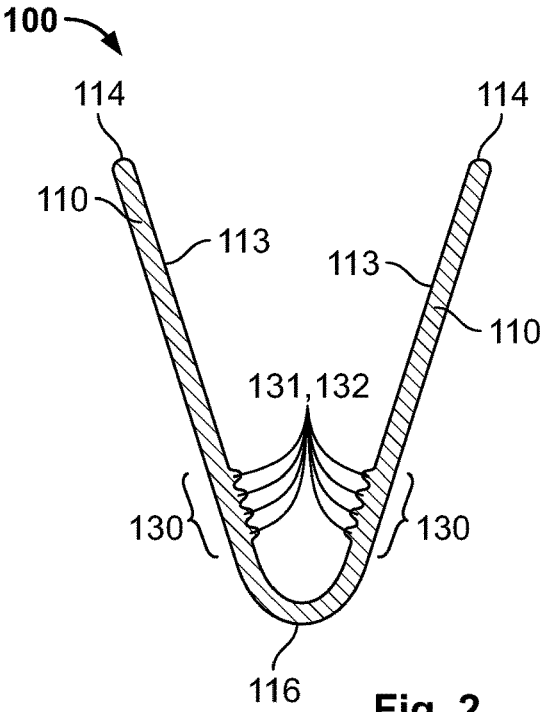
FIG. 2 is a sectional end view of the crimp contact.

FIG. 2 shows a cross-section through the crimp contact 100 from FIG. 1 in the front region 112. Two crimp flanks 110 stand symmetrically opposite each other. The crimp flanks 110 are connected to each other via a crimp back 116. Adjacent to the crimp back 116, both crimp flanks 110 have a structured region 130, which is designed in the form of structural elements 131. The structural elements 131 in this case are configured as elevations 132. The structural elements 131, i.e. the elevations 132, here in each case are arranged on an inner side 113 of the crimp flanks 110. In an embodiment, the elevations 132 have a height of up to 200 micrometers, with the height in this case indicating how far the elevations 132 project over the inner side 113 of the crimp flank 110.

Figure 3:
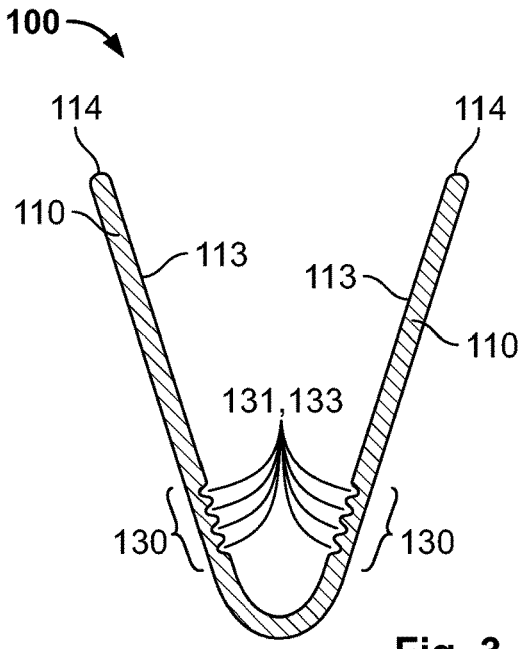
FIG. 3 is a sectional end view of a crimp contact according to another embodiment.

FIG. 3 shows a cross-section through a front region of a crimp contact 100 according to another embodiment, which corresponds to the crimp contact 100 from FIG. 1, provided that no differences are described hereinafter. In contrast to the elevations 132 of FIG. 2, the structural elements 131 in FIG. 3 are configured as depressions 133. In an embodiment, the depressions 133 have a depth of up to 200 micrometers, with the depth here being defined as the depth of the depression 133 relative to the inner side 113 of the crimp flank 110.

In both exemplary embodiments in FIGS. 2 and 3, when the crimp contact 100 is inserted into an appropriate crimping tool, the upper edge 114 of the respective crimp flank 110 is guided onto the inner side 113 of the respective crimp flank 110 and strikes the inner side 113 in the structured region 130. By way of the structural elements 131, a slippage of the upper edge 114 from the inner side 113 of the crimp flank 110 is reduced or avoided completely in this case. This is independent of whether the structural elements 131 are constructed as elevations 132 or depressions 133.

Figure 4:
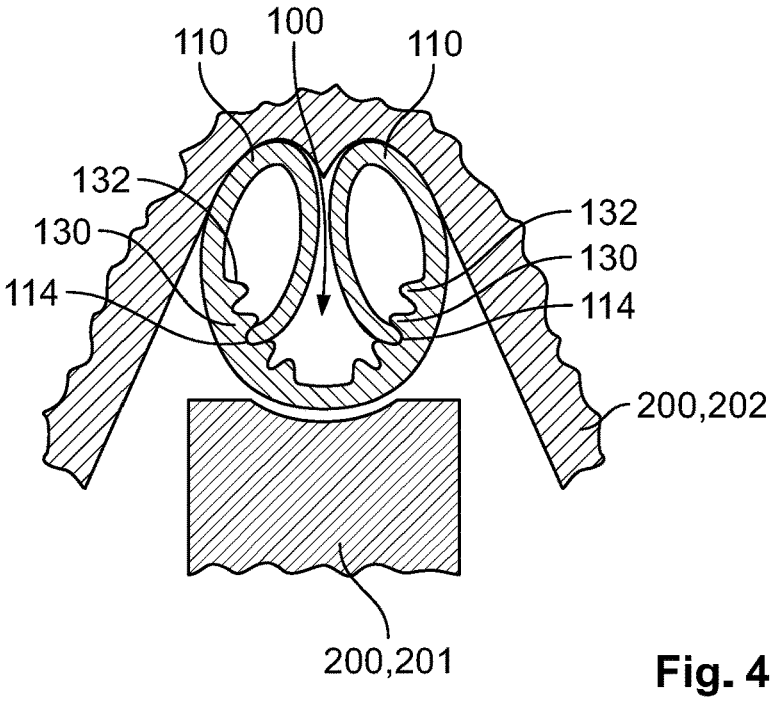
FIG. 4 is a sectional end view of the crimp contact of FIG. 1 in a crimping tool during a crimping procedure.

FIG. 4 shows a cross-section through the crimp contact 100 from FIG. 2 during a crimping procedure. For this purpose, the crimp contact 100 is inserted in a crimping tool 200, with the crimping tool 200 consisting of a lower part 201 and an upper part 202. In FIG. 4, the cross-section is depicted at the precise moment at which the upper edges 114 of the crimp flanks 110 strike the structured regions 130. The upper edge 114 hooks into the elevations 132, with the result that a slippage of the upper edge 114 downwards is avoided or the likelihood of such a slippage is reduced. If the crimping tool 200 is closed further, i.e. the upper part 202 moves further towards the lower part 201, the crimp flank 110 thus rolls further up and forms a hermetically closed-off region in the front region 112 of the crimp contact 100, such that a conductor inserted into the crimp contact 100 is no longer accessible via the front region 112. The crimping tool 200, in this case, can be configured as described in the specification of U.S. Pat. No. 9,331,446 B2. However, alternative configurations of the crimping tool 200 are also possible.

Instead of the structural elements 131, in another embodiment, the inner side 113 is roughened in the structured region 130, and therefore a slippage of the upper edge 114 upon striking the roughened, structured region 130 is likewise avoided or the likelihood of such a slippage is reduced. In this case, the roughening makes it possible to increase a friction between a pair of subregions of the crimp flank 110 compared to a smooth inner side 113 of the crimp flank 110; in the shown embodiment, the upper edge 114 and the structured region 130 on the inner side 113 of the crimp flank 110 are the subregions.

Figure 5:
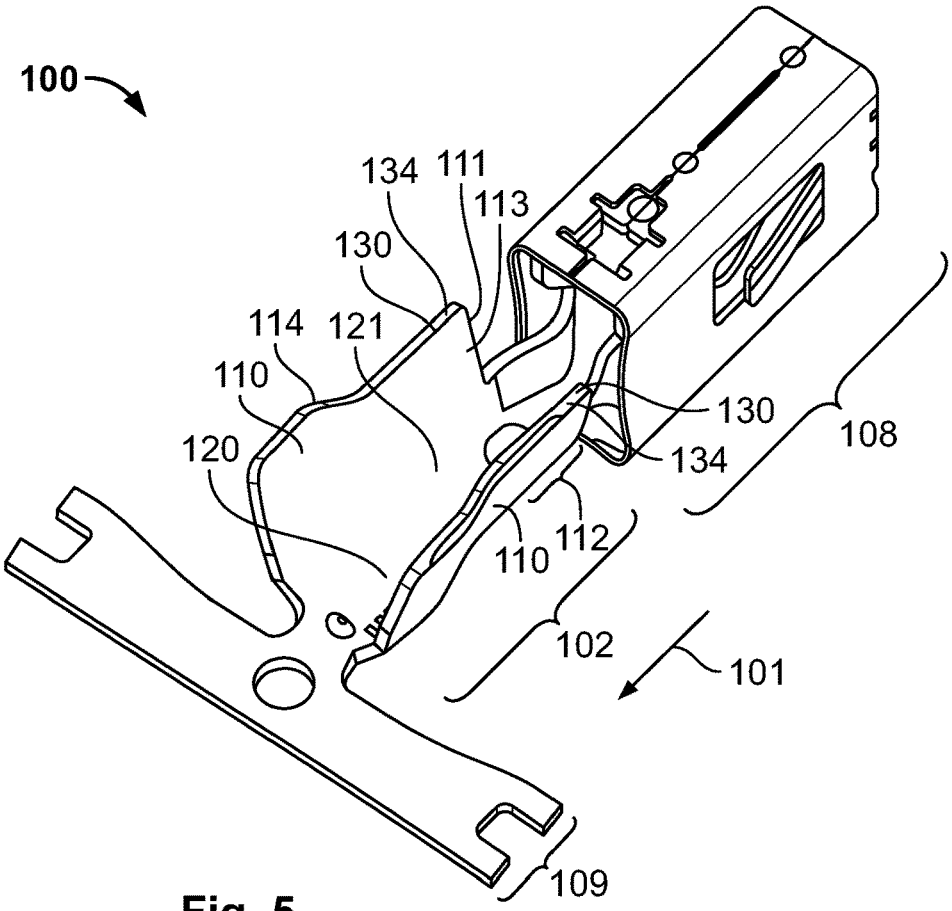
FIG. 5 is a perspective view of a crimp contact according to another embodiment.

FIG. 5 shows a crimp contact 100 according to another embodiment, which corresponds to the crimp contact 100 from FIG. 1, provided that no differences are described hereinafter. No structured regions are arranged on the inner sides 113 of the crimp flanks 110. The structured regions 130, in contrast, are formed at the upper edge 114 by a roughened region 134 of the upper edge 114. As a result of the roughening of the upper edge 114, during crimping, when the upper edge 114 strikes the inner side 113 of the crimp flank 110, the likelihood of a slippage is reduced or a slippage is likewise prevented completely.

In an embodiment, the crimp contact 100 can have both the structured region 130 with the structural elements 131 from FIG. 1 and the structured region 130 with the roughened region 134 at the upper edge 114 and thus to utilize the positive effects of the crimp contact 100 from FIG. 1 in addition to the positive effects of the crimp contact 100 from FIG. 5.

Figure 6:
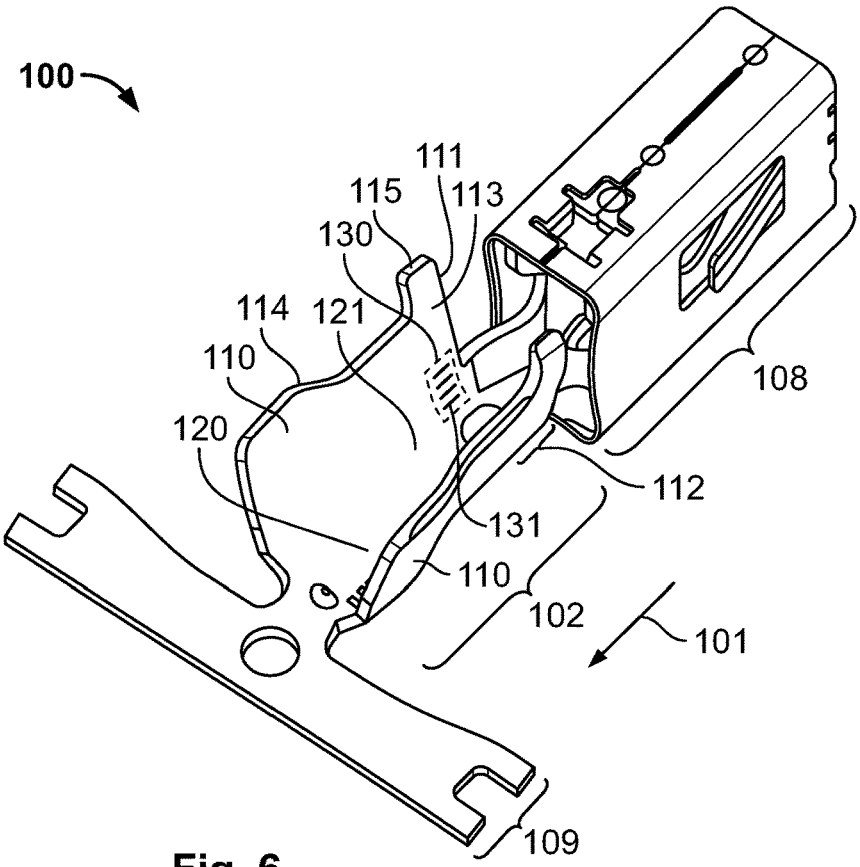
FIG. 6 is a perspective view of a crimp contact according to another embodiment.

FIG. 6 shows a crimp contact 100 according to another embodiment, which corresponds to the crimp contact 100 from FIG. 1, provided that no differences are described hereinafter. In the front region 112, the crimp flank 110 has a wing 115 protruding from the crimp flank 110. As a result of the fact that both the structured region 130 and the wing 115 are arranged in the front region 112 of the crimp flank 110, the upper edge 114 of the crimp flank 110, extending over the wing 115, engages in the structural elements 131 of the structured region 130 upon crimping, that is to say during the crimping procedure. By way of the wing 115, additional material of the crimp contact 100 is made available in the front region 112, with which material an improved sealing of the crimp contact 100 is made possible after the crimping in the front region 112. Additionally or alternatively, it can be envisaged that the upper edge 114 of the crimp flank 110 is structured, for example roughened, in the region of the wing 115, and as a result a further improvement in the crimping behavior of the crimp contact 100 is achieved. In an embodiment, a dimension of the wing 115 and a dimension of the elevations 132 or depressions 133 are matched to each other.

Figure 7:
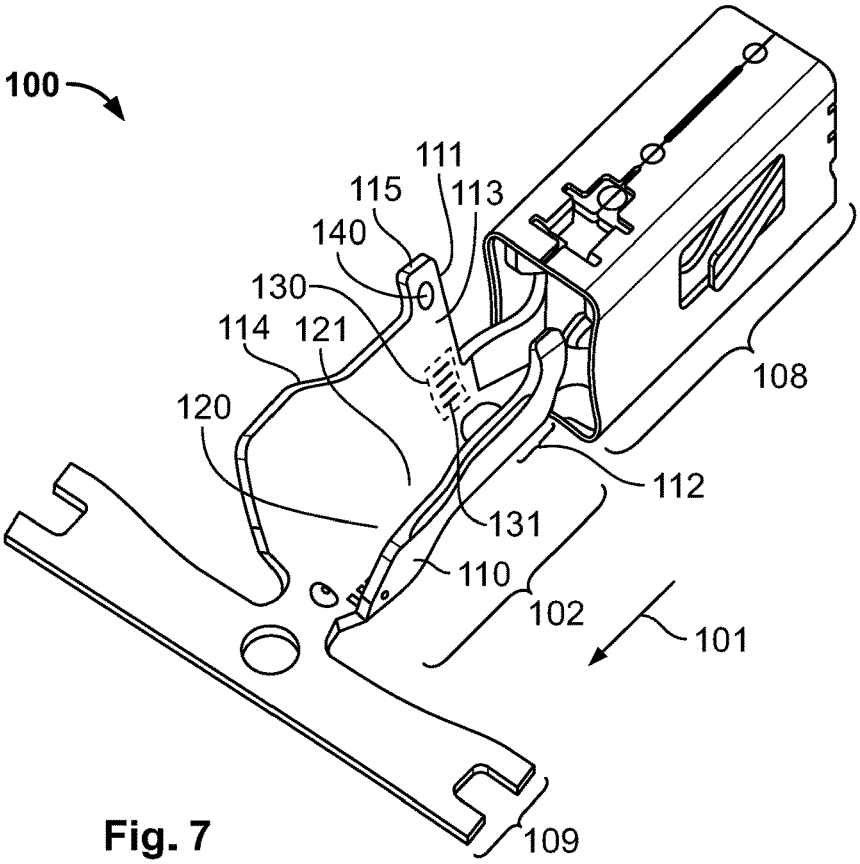
FIG. 7 is a perspective view of a crimp contact according to another embodiment.

FIG. 7 the crimp contact 100 from FIG. 6, with the crimp contact 100 having an additional sealing agent repository 140 in the region of the wing 115. The sealing agent repository 140 makes a sealing agent available, with which a further improvement in the sealing of the crimp contact 100 in the front region 112 is made possible during the crimping procedure.

The crimp contacts 100 from FIGS. 6 and 7 in this case are, in turn, constructed symmetrically, such that both crimp flanks 110 each have a wing 115. The structural elements 131 can be constructed similarly to FIGS. 2 and 3 as elevations or depressions. Additionally it is possible, as an alternative to the structural elements 131 in the structured region 130, to envisage a roughening, as already described above for the crimp contact 100 without wings 115. In the exemplary embodiments in FIGS. 6 and 7, it can be envisaged that the dimensions of the wings 115 and the dimensions of the structural elements 131 are matched to each other. For example, it can be envisaged that an expansion of the structural elements 131 in the longitudinal direction 101 accords with a width of the wings 115 in the longitudinal direction 101, or that the expansion of the structural elements 131 in the longitudinal direction 101 and the width of the wings 115 in the longitudinal direction 101 deviate from each other at most by 20 percent. It can likewise be envisaged that a spacing of the structural elements 131 accords with a sheet thickness in the region of the wings 115, in particular when the structural elements 131 are configured as elevations 132. If the structural elements 131 are configured as depressions 133, a dimension of the depression 133 perpendicular to the longitudinal direction 101 can accord with a sheet thickness in the region of the wings 115.

Figure 8:
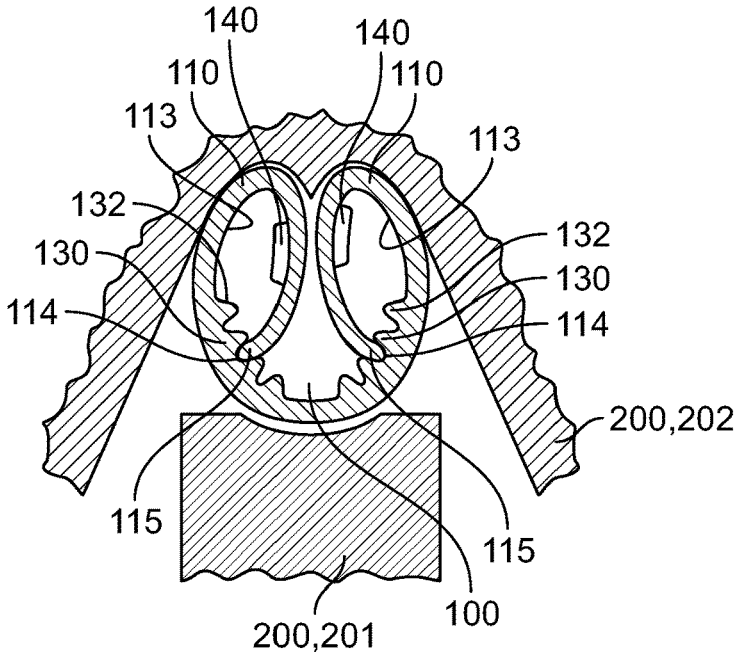
FIG. 8 is a sectional end view of the crimp contact of FIG. 7 in a crimping tool during a crimping procedure.

FIG. 8 shows the crimp contact 100 from FIG. 7 inside a crimping tool 200, with the crimping tool 200 being constructed similarly to the crimping tool 200 from FIG. 4. The upper edge 114 of the crimp flanks 110 is guided over the wings 115. During the crimping procedure, the upper edge 114 strikes the structured region 130 of the inner sides 113 of the crimp flanks 110, and makes it possible, similarly to FIG. 4, to avoid or reduce the likelihood of a slippage of the upper edge 114 or of the wing 115 from the inside 113 of the crimp flanks 110.

Figure 9:
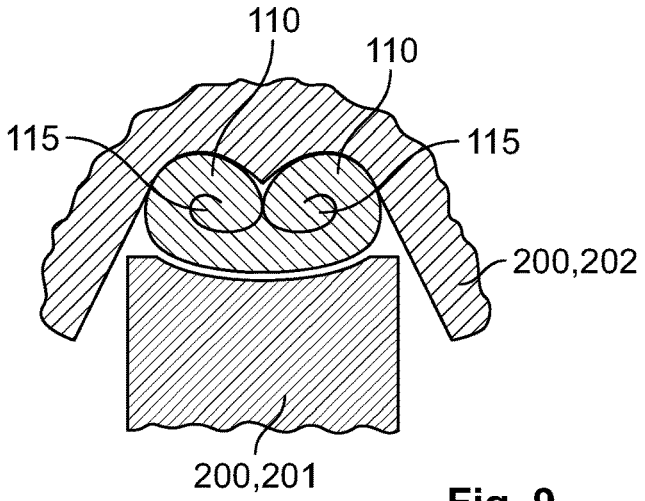
FIG. 9 is a sectional end view of the crimp contact of FIG. 8 after completion of the crimping procedure.

FIG. 9 shows a cross-section through the crimp contact 100 shown in FIG. 8 after a complete closure of the crimping tool 200. The wings 115 make so much material available that the crimp contact 100 makes a complete sealing of a crimp connection possible from the front. The sealing agent repository 140 shown in FIG. 8, in this case, serves to provide an additional sealing agent, with which any intermediate spaces inside the rolled-up crimp flanks 110 can additionally be sealed. Should gaps arise during the crimping upon rolling-up of the crimp flanks 110, these can be closed by the sealing agent.

Figure 10:
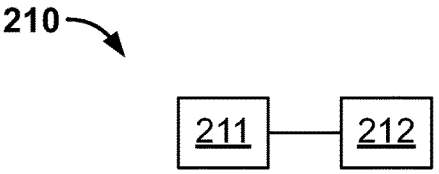
FIG. 10 is a flowchart of a manufacturing method.

FIG. 10 shows a flowchart 210 of a manufacturing method for a crimp contact 100, with which one of the described crimp contacts 100 can be manufactured. In a first provisioning step 211, in this case, a crimp contact 100 having a crimpable crimp flank 110 for enclosing a conductor after crimping, and having a receptacle 120 for the conductor, which extends in a longitudinal direction 101 of the crimp contact 100 up to a receiving end 121, is provided. The crimp flank 110 in this case extends in the longitudinal direction 101 over the receiving end 121 up to a front end 111. In this case, a front region 112 of the crimp contact 100 is arranged between the receiving end 121 and the front end 111. In a first structuring step 212, the structured region 130 in the front region 112 of the crimp contact 100 is now structured. This can comprise a roughening of the structured region 130, the formation of depressions 133 on the inner side 113 of the crimp flank 110 or the formation of elevations 132 on the inner side 113 of the crimp flank 110.

Figure 11:
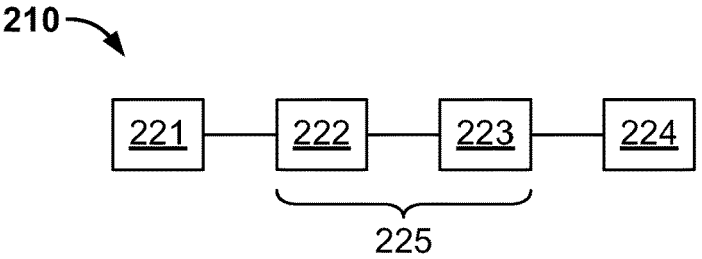
FIG. 11 is a flowchart of a manufacturing method according to another embodiment.

FIG. 11 shows a flowchart 210 of a manufacturing method for the crimp contact 100, in which, in a second provisioning step 221, firstly a metal sheet having a sheet thickness of up to three millimeters is provided. In an embodiment, the sheet thickness is between 150 micrometers and two millimeters. In an exemplary embodiment, the sheet thickness is between 200 and 400 micrometers. In a cutting-to-size step 222 following the second provisioning step 221, the metal sheet is appropriately cut to size. There now follows a second structuring step 223, which can correspond to the first structuring step 212 from FIG. 10. In a concluding bending step 224, the cut-to-size metal sheet is bent, in order to thereby form the crimp contact 100. This means that the structuring of the structured region 130 can take place, in particular, already during the manufacture of the crimp contact 100, in particular while the crimp contact 100 has not yet been brought into its final form. This enables an efficient and inexpensive manufacture of the crimp contact 100. In FIG. 11, the depiction likewise shows that the cutting-to-size step 222 and the second structuring step 223 can be carried out in a parallel cutting and structuring step 225.

Figure 12:
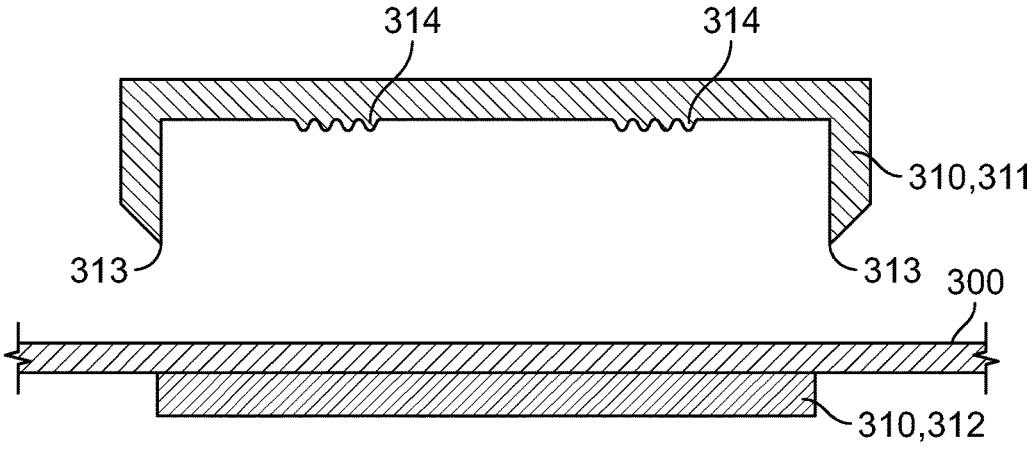
FIG. 12 is a sectional side view through a stamping tool according to an embodiment.

FIG. 12 shows a metal sheet 300 in a cutting and structuring tool 310. The cutting and structuring tool 310 has an upper part 311 and a lower part 312. The upper part 311 in this case has two cutting edges 313 and two stamps 314. The lower part 312 is configured in such a way that, when the upper part 311 is moved towards the lower part 312, the cutting edges 313 can be guided past the lower part 312 of the cutting and structuring tool 310, and in the process can take over the cutting-to-size of the metal sheet 300. The stamps 314 are configured in such a way that, using these, depressions can be stamped into the metal sheet 300, which depressions can then correspond to the depressions 133 from FIG. 3.

Figure 13:
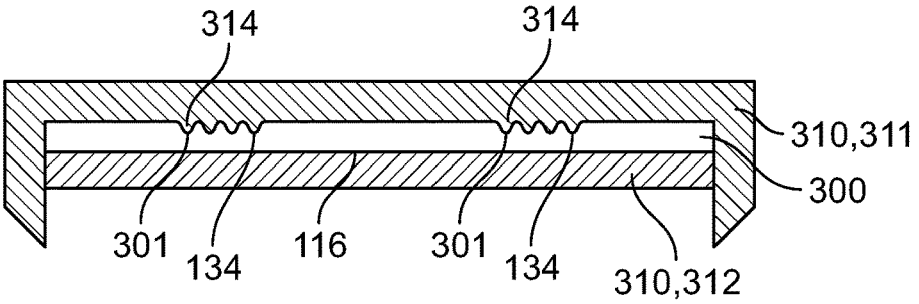
FIG. 13 is a sectional side view through the stamping tool after stamping.

FIG. 13 shows the metal sheet 300 after the closure of the cutting and structuring tool 310. With the cutting edges 313, the metal sheet 300 was brought into form, and the stamps 314 were pressed into the metal sheet 300. As a result, depressions 133 arise in the metal sheet 300. If the metal sheet 300 is now bent in such a way that the crimp back 116 is situated between the depressions 133, a crimp contact 100 constructed similarly to FIG. 3 can thus be produced. In this case, it is irrelevant whether the crimp contact 100 is to have wings 115 or not. In this case, the cutting edges 313 can be configured in such a way that the form of the crimp flanks 110 of the described crimp contacts 100 is produced by the cutting edges 313. As an alternative to the stamps 314, by which the depressions 133 are produced, the upper part 311 can also have depressions and the lower part 312 corresponding elevations, by which the elevations 132 from FIG. 2 are produced.

Figure 14:
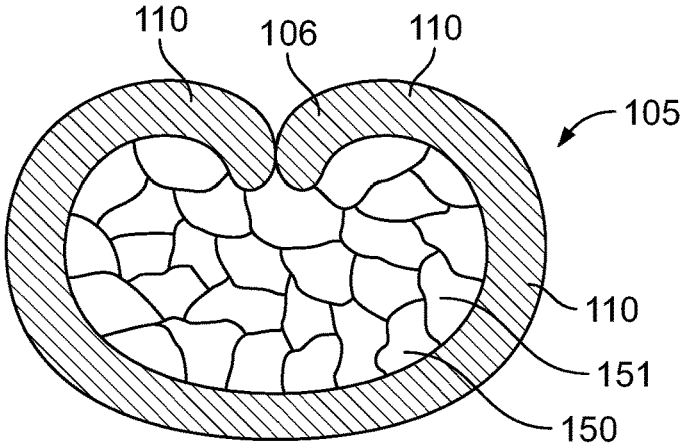
FIG. 14 is a sectional end view of a crimp connection according to an embodiment.

FIG. 14 shows a crimp connection 105, in which a conductor 150 is enclosed by two crimp flanks 110 of the crimp contact 100. The cross-section from FIG. 14 in this case is guided through the receptacle 120 from FIGS. 1, 5, 6 and 7, respectively. The conductor 150 is constructed in particular as a multicore conductor with several cores 151. As an alternative, the conductor 150 could also be a single-core conductor.

As a result of the enclosing of the conductor 150 by the crimp contact 100, as shown in FIG. 14, in which the crimp flanks 110 touch each other and therefore lead to covering of the conductor 150 and simultaneously to covering of the conductor 150 in the front region 112, in particular when the crimp contact 100 has wings as shown in FIGS. 6 and 7, this leads to the conductor 150 being completely covered by the crimp contact 100. This means in particular that a touching region, at which conductor 150 and crimp contact 100 touch each other, is not accessible to gases and/or liquids from the outside. This is particularly advantageous when the crimp contact 100 and the conductor 150 consist of different materials, since without complete coverage, oxygen could reach the connecting site between crimp contact 100 and conductor 150, and thus could contribute to an oxidation. In particular in the automobile industry, in which conductors 150 made of aluminum are used for weight reasons, these can then be combined with crimp contacts 100 made of copper. Copper is suitable for the crimp contact 100, compared to aluminum, because copper has a significantly better bendability and thus improved properties are enabled during the crimping procedure. Any apertures in the front region 112 can additionally be sealed by way of an additional sealing agent repository 140. This is therefore sensible in particular since copper and aluminum have clearly different potentials within the electrochemical series, and a material crossover from copper to aluminum is therefore particularly susceptible to corrosion.

Although the invention has been described and depicted more closely in detail by way of the preferred exemplary embodiments, the invention is not limited by the disclosed exemplary embodiments. Other variations can be derived therefrom and from the description of the invention, without departing from the scope of protection of the invention.

What is claimed is:

1. A crimp contact for crimping a conductor, comprising:

a crimp flank enclosing the conductor after crimping;

a receptacle receiving the conductor and extending in a longitudinal direction of the crimp contact up to a receiving end, the crimp flank extends in the longitudinal direction over the receiving end up to a front end; and a structured region in a front region of the crimp contact arranged between the receiving end and the front end, the structured region increases a friction of an engagement between an upper edge of the crimp flank and an inner side of the crimp flank during crimping.

2. The crimp contact of claim 1, wherein the crimp contact is formed from a metal sheet.

3. The crimp contact of claim 2, wherein the metal sheet has a sheet thickness up to three millimeters.

4. The crimp contact of claim 1, wherein the structured region is arranged on the inner side of the crimp flank.

5. The crimp contact of claim 4, wherein the structured region is formed by an elevation on the inner side of the crimp flank.

6. The crimp contact of claim 5, wherein the elevation has a height of up to 200 micrometers.

7. The crimp contact of claim 4, wherein the structured region is formed by a depression on the inner side of the crimp flank.

8. The crimp contact of claim 7, wherein the depression has a depth of up to 200 micrometers.

9. The crimp contact of claim 1, wherein the upper edge is structured in the front region to form the structured region.

10. The crimp contact of claim 1, further comprising a wing protruding from the crimp flank in the front region.

11. The crimp contact of claim 1, further comprising a sealing agent repository arranged in the front region.

12. A method for manufacturing a crimp contact, comprising:

providing a crimp contact having a crimp flank enclosing a conductor after crimping, a receptacle receiving the conductor and extending in a longitudinal direction of the crimp contact up to a receiving end, the crimp flank extends in the longitudinal direction over the receiving end up to a front end, a front region of the crimp contact is arranged between the receiving end and the front end; and structuring a structured region in the front region, the structured region increases a friction of an engagement between an upper edge of the crimp flank and an inner side of the crimp flank during crimping.

13. The method of claim 12, wherein the providing step includes providing a metal sheet, cutting the metal sheet to a size, and bending the metal sheet to form the crimp contact.

14. The method of claim 13, wherein the metal sheet has a sheet thickness up to three millimeters.

15. The method of claim 13, wherein the cutting step uses a cutting and structuring tool for stamping including a stamp.

16. The method of claim 15, wherein the structuring step takes place with the stamp.

17. A crimp connection, comprising:

a conductor; and a crimp contact having a crimp flank, a receptacle receiving the conductor and extending in a longitudinal direction of the crimp contact up to a receiving end, the crimp flank extends in the longitudinal direction over the receiving end up to a front end, and a structured region in a front region of the crimp contact arranged between the receiving end and the front end, the crimp flank is crimped around the conductor and the front region covers the conductor, the structured region increases a friction of an engagement between an upper edge of the crimp flank and an inner side of the crimp flank during crimping.

* * * * *